US011801691B2

(12) United States Patent
Takehana

(10) Patent No.: US 11,801,691 B2
(45) Date of Patent: Oct. 31, 2023

(54) INKJET PRINTER SUPPRESSING STRAY LIGHT FROM LIGHT IRRADIATION DEVICE

(71) Applicant: MIMAKI ENGINEERING CO., LTD., Nagano (JP)

(72) Inventor: Soichiro Takehana, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 17/642,699

(22) PCT Filed: Sep. 29, 2020

(86) PCT No.: PCT/JP2020/036820
§ 371 (c)(1),
(2) Date: Mar. 13, 2022

(87) PCT Pub. No.: WO2021/070669
PCT Pub. Date: Apr. 15, 2021

(65) Prior Publication Data

US 2022/0324242 A1 Oct. 13, 2022

(30) Foreign Application Priority Data

Oct. 10, 2019 (JP) ..... 2019-186753

(51) Int. Cl.
*B41J 11/00* (2006.01)
*B41J 2/14* (2006.01)

(52) U.S. Cl.
CPC ..... *B41J 11/00218* (2021.01); *B41J 2/14* (2013.01)

(58) Field of Classification Search
CPC .. B41J 11/00218; B41J 2/14; B41J 11/00214; B41J 2/01; B41J 25/00
See application file for complete search history.

(56) References Cited

U.S. PATENT DOCUMENTS

2014/0354743 A1* 12/2014 Tsuchiya ..... B41J 11/0021 347/102

FOREIGN PATENT DOCUMENTS

JP 2003177063 6/2003
JP 2004314304 11/2004
(Continued)

OTHER PUBLICATIONS

"International Search Report (Form PCT/ISA/210) of PCT/JP2020/036820," dated Dec. 22, 2020, with English translation thereof, pp. 1-4.

(Continued)

*Primary Examiner* — Bradley W Thies
(74) *Attorney, Agent, or Firm* — JCIPRNET

(57) ABSTRACT

An inkjet printer including a platen that supports a recording medium; an inkjet head having a nozzle surface that ejects ink, which cures by being irradiated with light, toward the recording medium; a light irradiation device that irradiates the ink attached to the recording medium with light; and a carriage that is mounted on the inkjet head and the light irradiation device, and is scanned with respect to the platen; where an uneven portion for suppressing stray light from the light irradiation device from reaching the nozzle surface is provided in a portion closer to the nozzle surface than the light irradiation device in a scanning direction; and the uneven portion is provided at a position facing a space on a path of the stray light from the light irradiation device to the nozzle surface in a space between the portion and the platen.

9 Claims, 7 Drawing Sheets

(56) References Cited

FOREIGN PATENT DOCUMENTS

| | | |
|---|---|---|
| JP | 2005047261 | 2/2005 |
| JP | 2005053221 | 3/2005 |
| JP | 2014231161 | 12/2014 |

OTHER PUBLICATIONS

"Office Action of Japan Counterpart Application", dated Aug. 2, 2023, with English translation thereof, pp. 1-10.

* cited by examiner

INKJET PRINTER SUPPRESSING STRAY LIGHT FROM LIGHT IRRADIATION DEVICE

TECHNICAL FIELD

The present invention relates to an inkjet printer that ejects ink.

BACKGROUND ART

As a conventional inkjet printer, there is known an inkjet printer including a platen that supports a recording medium; an inkjet head having a nozzle surface on which a nozzle that ejects ink, which cures by being irradiated with light, toward a recording medium supported by the platen is formed; a carriage on which the inkjet head is mounted and which is scanned with respect to the platen; a light irradiation device that is mounted on the carriage and irradiates the ink attached to the recording medium with light; and a cover that is mounted on the carriage and covers the light irradiation device (see Patent Literature 1). The conventional cover has an uneven portion for suppressing stray light from the light irradiation device from reaching the nozzle surface at a position facing a space on a path of the stray light from the light irradiation device to the nozzle surface in a space between the cover and the platen.

CITATION LIST

Patent Literature

Patent Literature 1: Japanese Unexamined Patent Publication No. 2004-314304

SUMMARY OF INVENTION

Technical Problems

As a result of intensive studies, the inventor of the present application obtained a finding that "as the uneven portion for suppressing the stray light from the light irradiation device from reaching the nozzle surface is disposed at a position closer to the nozzle surface of the inkjet head, the stray light from the light irradiation device can be effectively suppressed from reaching the nozzle surface by the uneven portion.".

However, in the conventional inkjet printer, since the uneven portion for suppressing the stray light from the light irradiation device from reaching the nozzle surface is provided in the cover of the light irradiation device, there is a problem that the uneven portion for suppressing the stray light from the light irradiation device from reaching the nozzle surface is not disposed at a position sufficiently close to the nozzle surface of the inkjet head, and the stray light from the light irradiation device cannot be sufficiently suppressed from reaching the nozzle surface by the uneven portion.

The present invention thus provides an inkjet printer in which stray light from a light irradiation device can be more effectively suppressed from reaching a nozzle surface by an uneven portion than the conventional art.

Solutions to Problems

An inkjet printer of the present invention includes a platen that supports a recording medium; an inkjet head having a nozzle surface on which a nozzle that ejects ink, which cures by being irradiated with light, toward the recording medium supported by the platen is formed; a light irradiation device that irradiates the ink attached to the recording medium with light; and a carriage that is mounted on the inkjet head and the light irradiation device, and is scanned with respect to the platen; where an uneven portion for suppressing stray light from the light irradiation device from reaching the nozzle surface is provided in a portion closer to the nozzle surface than the light irradiation device in a direction in which the carriage is scanned with respect to the platen; and the uneven portion is provided at a position facing a space on a path of the stray light from the light irradiation device to the nozzle surface in a space between the portion and the platen.

The inkjet printer of the present invention more effectively suppresses the stray light from the light irradiation device from reaching the nozzle surface as the uneven portion for suppressing the stray light from the light irradiation device from reaching the nozzle surface is disposed at a position closer to the nozzle surface of the inkjet head than the conventional art.

The inkjet printer of the present invention may include a head base on which the inkjet head is mounted, where the carriage may mount the inkjet head by mounting the head base, and the head base may include the portion.

Since the conventional inkjet printer has the uneven portion for suppressing the stray light from the light irradiation device from reaching the nozzle surface provided in the cover of the light irradiation device, when at least one of the inkjet head and the cover is installed on the carriage while being deviated from a position designed in advance, the uneven portion of the cover is deviated from a position designed in advance with respect to the nozzle surface of the inkjet head, and as a result the stray light from the light irradiation device cannot be effectively suppressed from reaching the nozzle surface by the uneven portion. The inkjet printer of the present invention has the uneven portion for suppressing the stray light from the light irradiation device from reaching the nozzle surface provided in the head base on which the inkjet head is mounted, and hence the possibility of the uneven portion being deviated from a position designed in advance with respect to the nozzle surface can be suppressed more than in the conventional art, and as a result the stray light from the light irradiation device can be more effectively suppressed from reaching the nozzle surface by the uneven portion than the conventional art.

In the inkjet printer of the present invention, the uneven portion may be formed on a surface facing the recording medium supported by the platen in the portion, and a distance between the recording medium supported by the platen and a surface of the portion facing the recording medium may be shorter than a distance between the recording medium supported by the platen and a surface of the light irradiation device facing the recording medium.

It is possible to reduce the possibility of the light irradiation device getting caught on the recording medium during scanning of the carriage by making the opposing distance between the light irradiation device and the recording medium longer than the opposing distance between the uneven portion (the portion) and the recording medium. As a result, stray light from the light irradiation device is less likely to reach the nozzle surface as compared with the case where the uneven portion is provided in the light irradiation device. When the uneven portion is provided on the head base, the print quality improves as the head gap becomes shorter.

In the inkjet printer of the present invention, the carriage may include the portion.

Since the conventional inkjet printer has the uneven portion for suppressing the stray light from the light irradiation device from reaching the nozzle surface provided in the cover of the light irradiation device, when at least one of the inkjet head and the cover is installed on the carriage while being deviated from a position designed in advance, the uneven portion of the cover is deviated from a position designed in advance with respect to the nozzle surface of the inkjet head, and as a result the stray light from the light irradiation device cannot be effectively suppressed from reaching the nozzle surface by the uneven portion. The inkjet printer of the present invention has the uneven portion for suppressing the stray light from the light irradiation device from reaching the nozzle surface provided in the carriage mounting the head base on which the inkjet head is mounted, and hence the possibility of the uneven portion being deviated from a position designed in advance with respect to the nozzle surface can be suppressed more than in the conventional art, and as a result the stray light from the light irradiation device can be more effectively suppressed from reaching the nozzle surface by the uneven portion than the conventional art.

In the inkjet printer of the present invention, the portion may be formed of metal, and the uneven portion may be surface-treated by sandblasting.

With this configuration, in the inkjet printer of the present invention, the unevenness finer than the grooves forming the uneven portions are formed on the surface of the uneven portions by the sandblasting, and thus the stray light from the light irradiation device is scattered by the fine unevenness due to the sandblast in the uneven portions, and the stray light from the light irradiation device can be suppressed from reaching the nozzle surface. As a result, stray light from the light irradiation device can be more effectively suppressed from reaching the nozzle surface.

In the inkjet printer of the present invention, the portion may be formed of aluminum, and the uneven portion may have the surface subjected to alumite treatment.

With this configuration, in the inkjet printer of the present invention, the fine unevenness by the alumite treatment are formed on the surface of the uneven portion, so that the stray light from the light irradiation device is scattered by the fine unevenness due to the alumite in the uneven portions, and the stray light from the light irradiation device can be suppressed from reaching the nozzle surface. As a result, stray light from the light irradiation device can be more effectively suppressed from reaching the nozzle surface.

In the inkjet printer of the present invention, the surface of the uneven portion may be black.

With this configuration, in the inkjet printer of the present invention, the stray light from the light irradiation device is absorbed by the surface of the uneven portion, and the stray light from the light irradiation device is suppressed from reaching the nozzle surface. As a result, stray light from the light irradiation device can be more effectively suppressed from reaching the nozzle surface.

In the inkjet printer of the present invention, the stray light may be reflected light reflected by the recording medium supported by the platen.

In the inkjet printer of the present invention, the uneven portion may be surface-treated to a satin form.

With this configuration, in the inkjet printer of the present invention, the fine unevenness are formed on the surface of the uneven portion, and thus the stray light from the light irradiation device is scattered by the fine unevenness on the surface of the uneven portions, so that the stray light from the light irradiation device can be suppressed from reaching the nozzle surface, and as a result, the stray light from the light irradiation device can be more effectively suppressed from reaching the nozzle surface.

Effect of the Invention

An inkjet printer of the present invention can more effectively suppress stray light from a light irradiation device from reaching a nozzle surface by an uneven portion than the conventional art.

DESCRIPTION OF EMBODIMENT

Hereinafter, one embodiment of the present invention will be described with reference to the drawings.

First, the configuration of an inkjet printer according to the present embodiment will be described.

Figure 1:
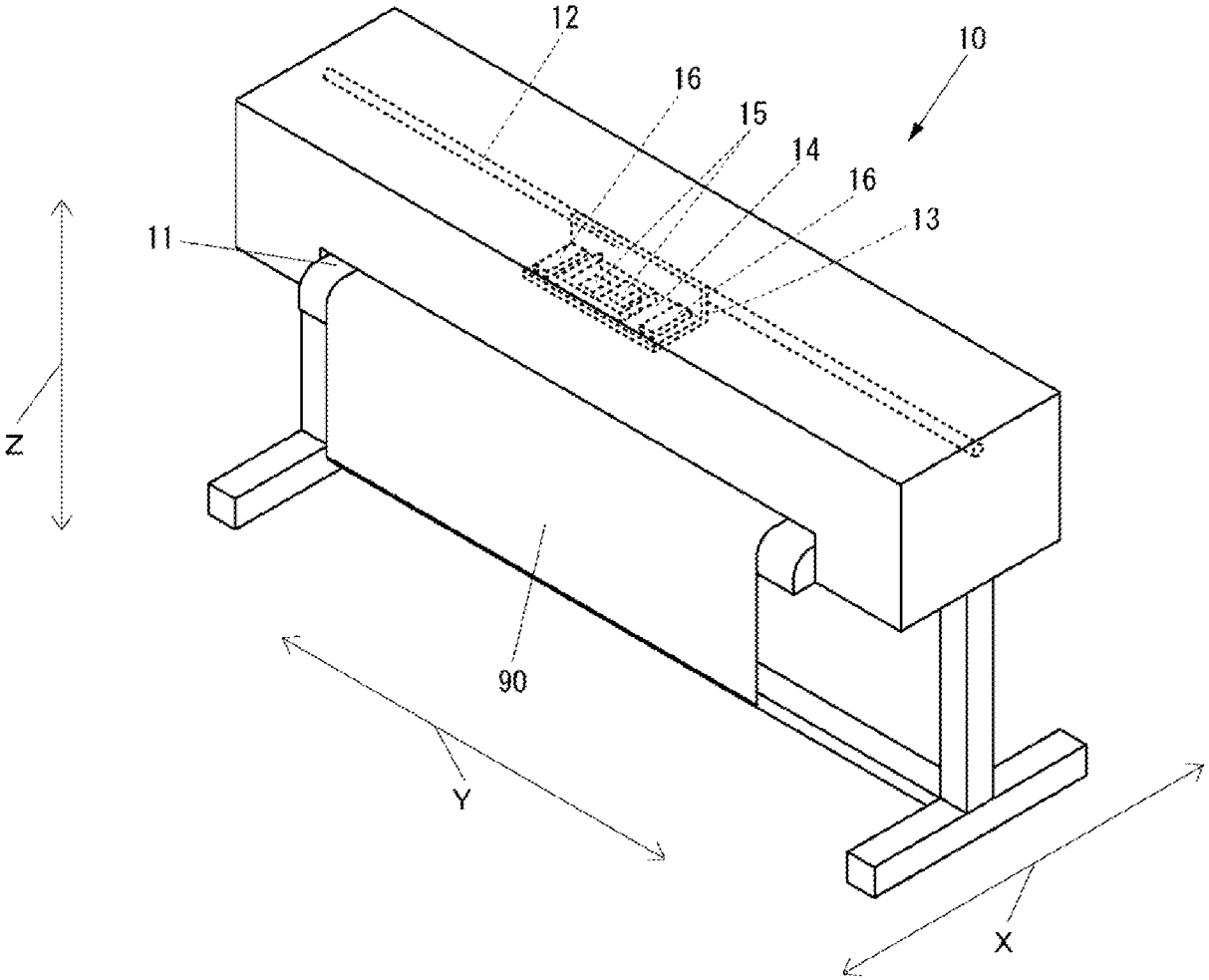
FIG. 1 is a perspective view of an inkjet printer according to one embodiment of the present invention.

FIG. 1 is a perspective view of an inkjet printer 10 according to the present embodiment.

As shown in FIG. 1, the inkjet printer 10 includes a platen 11 that supports a recording medium 90 from the lower side in the vertical direction indicated by an arrow Z; a rail 12 that extends in the left-right direction indicated by an arrow Y orthogonal to the vertical direction; a carriage 13 that is disposed on the upper side in the vertical direction with respect to the recording medium 90 supported by the platen 11 and is supported by the rail 12 so as to be movable in the left-right direction; a head base 14 mounted on the carriage 13; a plurality of inkjet heads 15 mounted on the head base 14; and two ultraviolet (UV) light emitting diodes (LED) lamp parts 16 mounted on the carriage 13 on both sides of the head base 14 in the left-right direction. The ink ejected by the inkjet head 15 is a UV ink that cures by being irradiated with UV.

Figure 2:
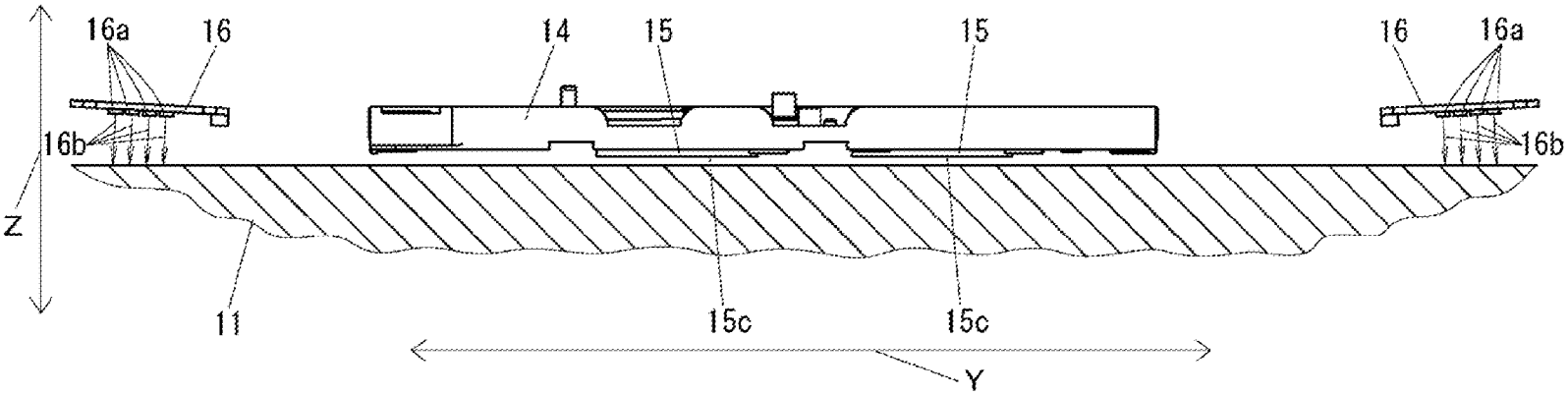
FIG. 2 is a front view of the vicinity of a head base shown in FIG. 1.
Figure 3:
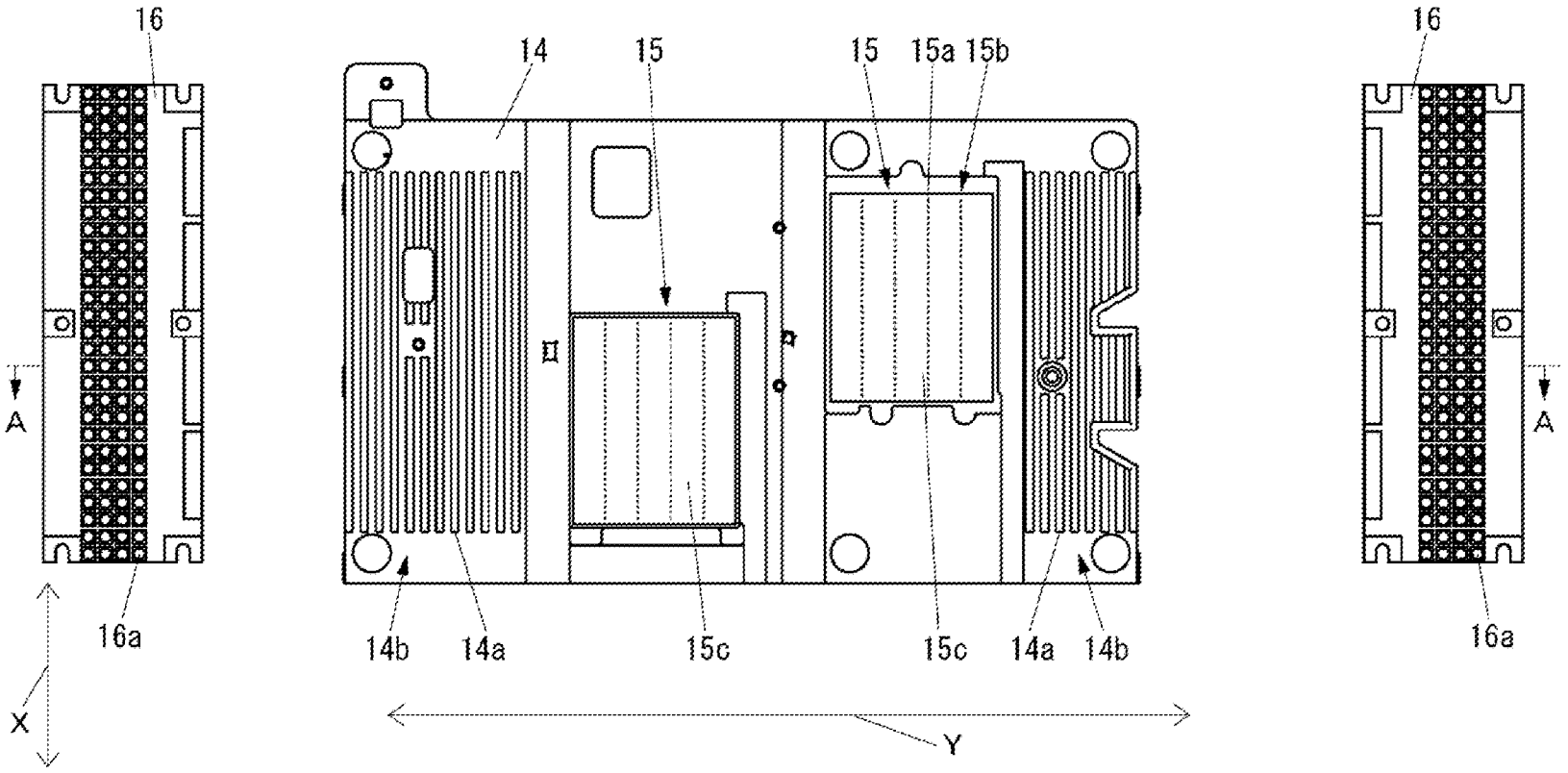
FIG. 3 is a bottom view of the vicinity of the head base shown in FIG. 1.
Figure 4:
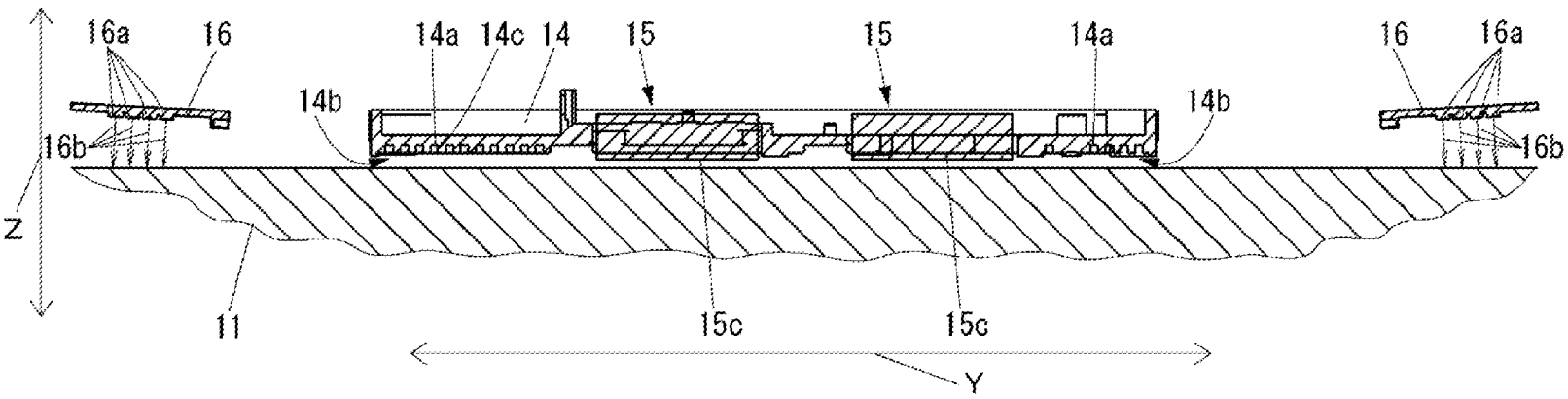
FIG. 4 is a cross-sectional view taken along the line A-A of FIG. 3.

FIG. 2 is a front view of the vicinity of the head base 14. FIG. 3 is a bottom view of the vicinity of the head base 14. FIG. 4 is a cross-sectional view taken along the line A-A of FIG. 3. In FIGS. 2 to 4, the carriage 13 is omitted.

As shown in FIGS. 2 to 4, the inkjet head 15 has a nozzle surface 15*c* where a nozzle row 15*b* in which a plurality of nozzles 15*a* for ejecting ink downward in the vertical direction are arranged is formed. The nozzle row 15*b* extends in the front-back direction indicated by an arrow X orthogonal to both the vertical direction and the left-right direction.

In the UVLED lamp part 16, a plurality of UVLED lamps 16*a* serving as a light irradiation device for emitting UV are arranged in the left-right direction and the front-back direction. The UVLED lamp 16*a* mainly emits UV in a direction indicated by an arrow 16*b* inclined with respect to the vertical direction so as to move away from the nozzle surface 15*c*.

The head base 14 has an uneven portion 14*b*, in which a plurality of grooves 14*a* are formed side by side in the left-right direction, provided between the inkjet head 15 and the UVLED lamp 16*a* in the left-right direction. The uneven portion 14*b* is for suppressing stray light from the UVLED lamp 16*a* from reaching the nozzle surface 15*c*. The head base 14 includes the uneven portion 14*b* at a position facing a space on a path of the stray light from the UVLED lamp 16*a* to the nozzle surface 15*c* in the space with the platen 11. The groove 14*a* is open on the lower side in the vertical direction and extends in the front-back direction. The depth of the groove 14*a* in the vertical direction is, for example, 2 mm. A surface 14*c* on the nozzle surface 15*c* side in the left-right direction among the surfaces forming the groove 14*a* is a surface to which the stray light from the UVLED lamp 16*a* easily enters first among the surfaces forming the groove 14*a*. The head base 14 is made of, for example, aluminum, and is manufactured by, for example, die casting. In the head base 14, the uneven portions 14*b* are subjected to surface treatment by sandblasting to form unevenness finer than the grooves 14*a*, and then the uneven portions 14*b* are subjected to alumite treatment in black.

The inkjet head 15 and the UVLED lamp 16*a* are arranged side by side in a direction in which the carriage 13 is scanned with respect to the platen 11, that is, in a direction indicated by the arrow Y. The uneven portion 14*b* is disposed between the inkjet head 15 and the UVLED lamp 16*a* in the direction indicated by the arrow Y.

The stray light from the UVLED lamp 16*a* is, for example, reflected light reflected by the recording medium 90 supported by the platen 11.

Figure 5:
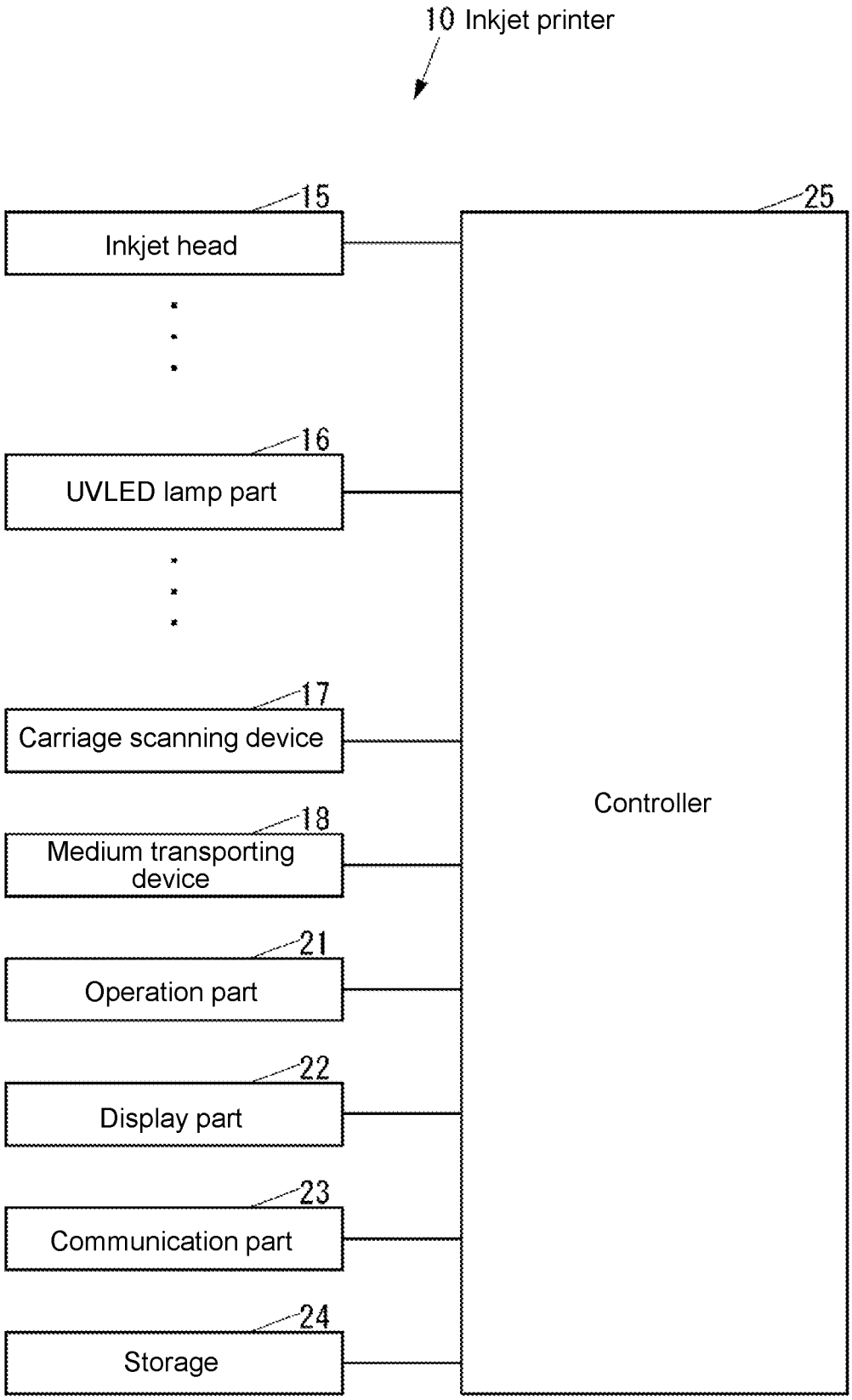
FIG. 5 is a block diagram of the inkjet printer shown in FIG. 1.

FIG. 5 is a block diagram of the inkjet printer 10.

As shown in FIG. 5, the inkjet printer 10 includes the inkjet head 15 described above, the UVLED lamp part 16 described above, a carriage scanning device 17 that moves the carriage 13 (see FIG. 1) in the left-right direction, that is, the main scanning direction along the rail 12 (see FIG. 1), a medium transporting device 18 that transports the recording medium 90 (see FIG. 1) in the front-back direction, that is, the sub scanning direction, an operation part 21 such as, for example, a button to which various operations are input, a display part 22 such as a liquid crystal display (LCD) that displays various information, a communication part 23 which is a communication device that communicates with an external device through a network such as local area network (LAN) or Internet or directly in a wired or wireless manner without interposing the network, a storage 24 which is a nonvolatile storage device such as a semiconductor memory or a hard disk drive (HDD), for example, that stores various types of information, and a controller 25 that controls the entire inkjet printer 10.

The controller 25 includes, for example, a central processing unit (CPU), a read only memory (ROM) that stores programs and various data in advance, and a random access memory (RAM) used as a work area of the CPU. The CPU executes the program stored in the ROM or the storage 24.

Next, the operation of the inkjet printer 10 will be described.

Upon receiving the print data through the communication part 23, the controller 25 executes printing on the recording medium 90 based on the print data. That is, the controller 25 moves the carriage 13 in the main scanning direction by the carriage scanning device 17 to eject ink toward the recording medium 90 by the inkjet head 15, and irradiates the ink attached to the recording medium 90 with light from the UVLED lamp part 16 to execute printing on the recording medium 90 in the main scanning direction. Furthermore, when printing on the recording medium 90 in the main scanning direction is executed, the controller 25 transports the recording medium 90 in the sub scanning direction by the medium transporting device 18, as necessary, thereby changing the position of printing with respect to the recording medium 90 in the sub scanning direction, and thereafter executing printing with respect to the recording medium 90 in the main scanning direction again.

Figure 6:
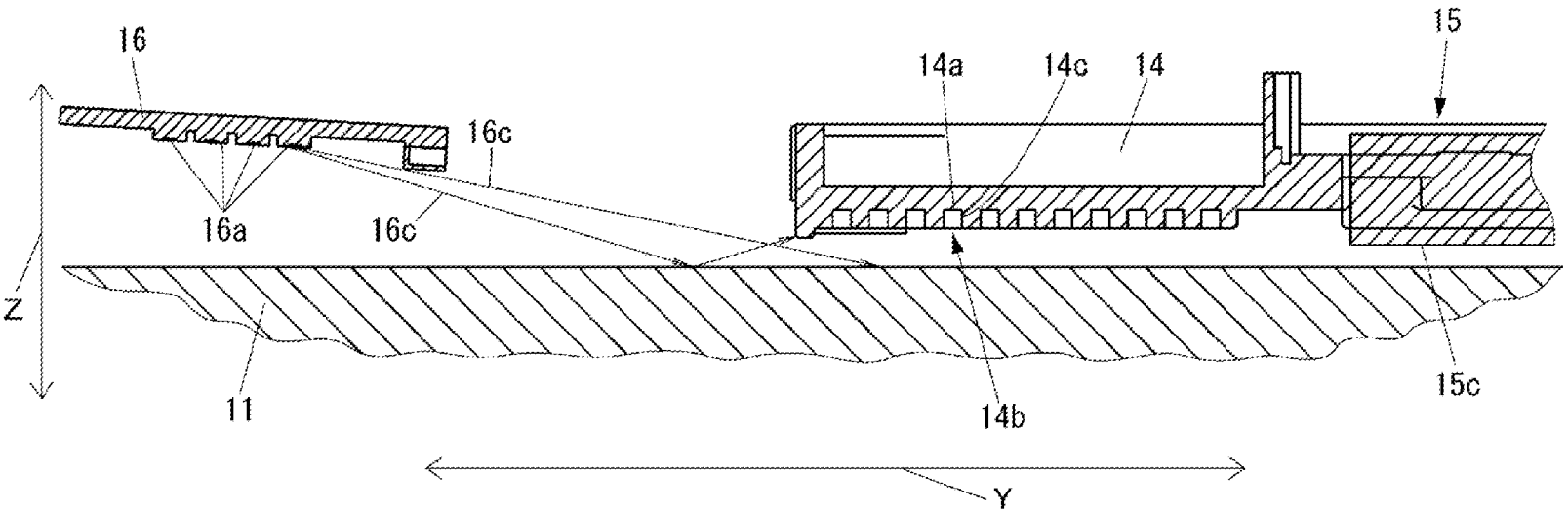
FIG. 6 is a front cross-sectional view of the vicinity of an uneven portion shown in FIG. 4.

FIG. 6 is a front cross-sectional view of the vicinity of an uneven portion 14*b*. In FIG. 6, the carriage 13 is omitted.

When the light is emitted by the UVLED lamp part 16, the light emitted by the UVLED lamp part 16 may enter the space between the platen 11 and the head base 14 directly or by being reflected off an object such as the recording medium 90, for example, as indicated by an arrow 16*c* in FIG. 6. However, the light entering the space between the platen 11 and the head base 14 is absorbed or reflected by the surface of the uneven portion 14*b* of the head base 14, so that the possibility of reaching the inkjet head 15 is suppressed.

Figure 7:
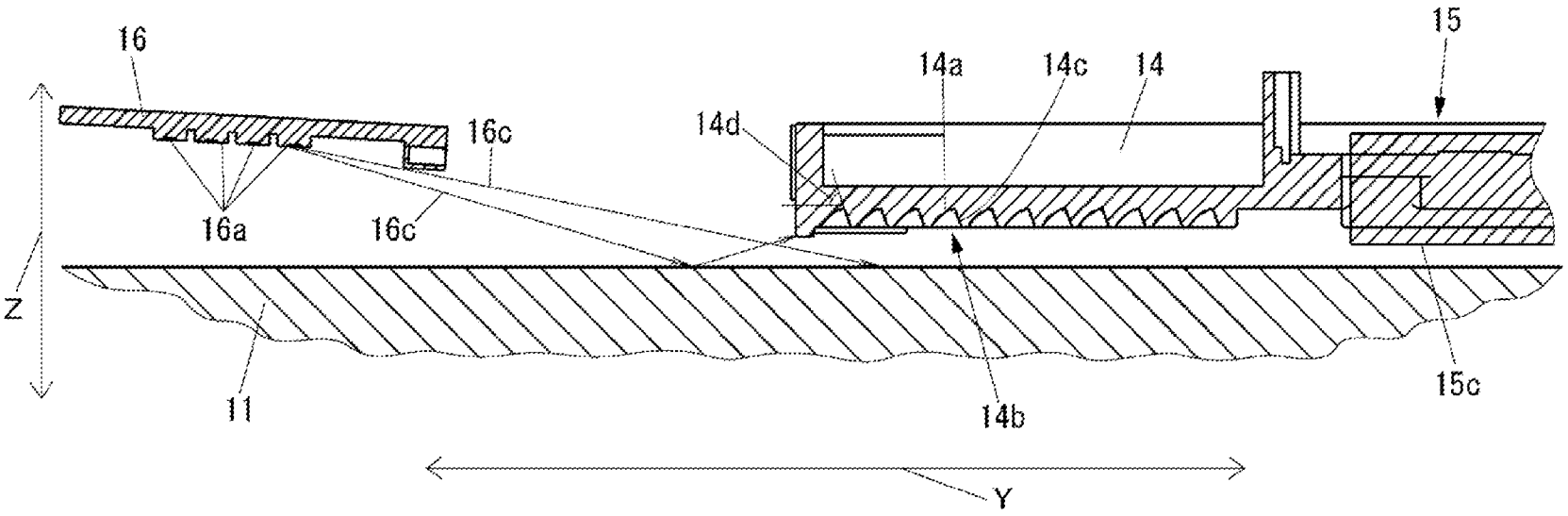
FIG. 7 is a front cross-sectional view of the vicinity of an uneven portion in an example different from the example shown in FIG. 6.

In the above description, the surface 14*c* on the nozzle surface 15*c* side in the left-right direction among the surfaces forming the groove 14*a* is orthogonal to the left-right direction. However, as illustrated in FIG. 7, the surface 14*c* may be inclined at an angle 14*d* other than 90° with respect to the left-right direction. In FIG. 7, the carriage 13 is omitted. The angle 14*d* of the surface 14*c* with respect to the left-right direction has an appropriate angle according to various factors such as the distance between the UVLED lamp 16*a* and the inkjet head 15, the height from the platen 11 to the inkjet head 15, and the installable range of the uneven portion 14*b* in the head base 14.

As described above, in the inkjet printer 10, the uneven portion 14*b* for suppressing the stray light from the UVLED lamp 16*a* from reaching the nozzle surface 15*c* is disposed at a position closer to the nozzle surface 15*c* of the inkjet head 15 than in the conventional art, so that the stray light from the UVLED lamp 16*a* can be more effectively suppressed from reaching the nozzle surface 15*c* by the uneven portion 14*b* than in the conventional art.

Since the conventional inkjet printer has the uneven portion for suppressing the stray light from the light irradiation device from reaching the nozzle surface provided in the cover of the light irradiation device, when at least one of the inkjet head and the cover is installed on the carriage while being deviated from a position designed in advance, the uneven portion of the cover is deviated from a position designed in advance with respect to the nozzle surface of the inkjet head, and as a result the stray light from the light irradiation device cannot be effectively suppressed from reaching the nozzle surface by the uneven portion. The inkjet printer 10 has the uneven portion 14*b* for suppressing the stray light from the UVLED lamp 16*a* from reaching the nozzle surface 15*c* provided in the head base 14 on which the inkjet head 15 is mounted, and hence the possibility of the uneven portion 14*b* being deviated from a position designed in advance with respect to the nozzle surface 15*c* can be further suppressed than in the conventional art, and as a result the stray light from the UVLED lamp 16*a* can be more effectively suppressed from reaching the nozzle surface 15*c* by the uneven portion 14*b* than the conventional art.

The inkjet printer 10 can effectively suppress the stray light from the UVLED lamp 16*a* from reaching the nozzle surface 15*c*, and thus can effectively suppress the ink attached to the nozzle surface 15*c* from adhering to the nozzle surface 15*c*.

Since the inkjet printer 10 does not need to include a cover that covers the UVLED lamp 16*a* as in the conventional art, the number of parts can be reduced, and as a result, the manufacturing cost can be reduced.

In the inkjet printer 10, the distance between the recording medium 90 supported by the platen 11 and the surface of the head base 14 facing the recording medium 90 is shorter than the distance between the recording medium 90 supported by the platen 11 and the surface of the UVLED lamp 16*a* facing the recording medium 90. With this configuration, in the inkjet printer 10, the surface of the UVLED lamp 16*a* facing the recording medium 90 is farther than the surface of the head base 14 facing the recording medium 90 with respect to the distance from the recording medium 90 supported by the platen 11, and thus, the possibility of the UVLED lamp 16*a* getting caught at the recording medium 90 and causing a jam when the carriage 13 is scanned with respect to the platen 11 can be reduced. Furthermore, the inkjet printer 10 forms the uneven portion 14*b* on the surface of the head base 14 facing the recording medium 90 by making the surface of the head base 14 facing the recording medium 90 closer to the surface of the UVLED lamp 16*a* facing the recording medium 90 with respect to the distance from the recording medium 90 supported by the platen 11, so that the stray light from the UVLED lamp 16*a* can be effectively suppressed from reaching the nozzle surface 15*c* by the uneven portion 14*b* as compared with the case in which the uneven portion is formed on the surface of the UVLED lamp part 16 facing the recording medium 90. Furthermore, in the inkjet printer 10, the surface of the head base 14 facing the recording medium 90 is closer than the surface of the UVLED lamp 16*a* facing the recording medium 90 with respect to the distance from the recording medium 90 supported by the platen 11, and hence the distance between the recording medium 90 supported by the platen 11 and the nozzle surface 15*c*, which is the surface of the inkjet head 15 facing the recording medium 90, that is, the head gap is short, and as a result, the print quality can be improved.

In the inkjet printer 10, the unevenness finer than the grooves 14*a* forming the uneven portion 14*b* are formed on the surface of the uneven portion 14*b* by sandblasting, and thus the stray light from the UVLED lamp 16*a* is scattered by the fine unevenness formed by sandblasting on the uneven portion 14*b*, whereby the stray light from the UVLED lamp 16*a* can be suppressed from reaching the nozzle surface 15*c*, and as a result, the stray light from the UVLED lamp 16*a* can be more effectively suppressed from reaching the nozzle surface 15*c*.

In the inkjet printer 10, fine unevenness is formed on the surface of the uneven portion 14*b* by sandblasting in the present embodiment, but fine unevenness may not be formed on the surface of the uneven portion 14*b* by sandblasting. The manufacturing cost can be reduced by omitting the sandblasting process.

In the inkjet printer 10, the fine unevenness by alumite are formed on the surface of the uneven portion 14*b*, and thus the stray light from the UVLED lamp 16*a* is scattered by the fine unevenness formed by alumite on the uneven portion 14*b*, whereby the stray light from the UVLED lamp 16*a* can be suppressed from reaching the nozzle surface 15*c*, and as a result, the stray light from the UVLED lamp 16*a* can be more effectively suppressed from reaching the nozzle surface 15*c*.

In the inkjet printer 10, the surface of the uneven portion 14*b* is alumite in the present embodiment, but the surface of the uneven portion 14*b* may not be alumite. The manufacturing cost can be reduced by omitting the alumite treatment.

In the inkjet printer 10, the uneven portion 14*b* may be surface-treated to a satin form by a method other than sandblasting or alumite. In the inkjet printer 10, when the uneven portion 14*b* is surface treated to a satin form, the fine unevenness are formed on the surface of the uneven portion 14*b*, and thus the stray light from the UVLED lamp 16*a* is scattered by the fine unevenness formed on the surface of the uneven portion 14*b*, whereby the stray light from the UVLED lamp 16*a* can be suppressed from reaching the nozzle surface 15*c*, and as a result, the stray light from the UVLED lamp 16*a* can be more effectively suppressed from reaching the nozzle surface 15*c*.

In the inkjet printer 10, the surface of the uneven portion 14*b* is black, and thus the stray light from the UVLED lamp 16*a* is absorbed by the surface of the uneven portion 14*b*, whereby the stray light from the UVLED lamp 16*a* can be suppressed from reaching the nozzle surface 15*c*, and as a result, the stray light from the UVLED lamp 16*a* can be more effectively suppressed from reaching the nozzle surface 15*c*.

In the inkjet printer 10, the surface of the uneven portion 14*b* is formed in black by alumite in the present embodiment, but for example, may be formed in black by a method other than alumite such as plating or painting.

In the inkjet printer 10, the surface of the uneven portion 14*b* is formed in black in the present embodiment, but the surface of the uneven portion 14*b* may be formed in a color other than black, or the surface of the uneven portion 14*b* may not be colored. The manufacturing cost can be reduced by omitting the coloring process of the uneven portion 14*b*.

In the inkjet printer 10, the head base 14 is formed of aluminum in the present embodiment. However, in the inkjet printer 10, the head base 14 may be formed of a metal other than aluminum, and the head base 14 may be formed of a material other than metal such as, for example, resin.

In the present embodiment, the ink ejected by the inkjet head 15 is a UV ink that cures by being irradiated with UV. However, the ink ejected by the inkjet head 15 may be an ink that cures by being irradiated with light other than UV.

In the present embodiment, the inkjet printer 10 includes the uneven portion 14*b* on the head base 14. However, the uneven portion for suppressing the stray light from the UVLED lamp 16*a* from reaching the nozzle surface 15*c* merely needs to be provided at a portion closer to the nozzle surface 15*c* than the UVLED lamp 16*a* in the direction in which the carriage 13 is scanned with respect to the platen 11, that is, in the direction indicated by the arrow Y, and thus may be provided at a portion other than the head base 14. For example, the inkjet printer 10 may include the uneven portion similar to the uneven portion 14*b* at a position facing the space on the path of the stray light from the UVLED lamp 16*a* to the nozzle surface 15*c* in the space between the carriage 13 and the platen 11, instead of the uneven portion 14*b* or in addition to the uneven portion 14*b*. Furthermore, the inkjet printer 10 may include an uneven portion for suppressing the stray light from the UVLED lamp 16*a* from reaching the nozzle surface 15*c* in the inkjet head 15.

When the inkjet printer 10 includes the uneven portion similar to the uneven portion 14*b* at a position facing the space on the path of the stray light from the UVLED lamp

16*a* to the nozzle surface 15*c* in the space between the carriage 13 and the platen 11 instead of the uneven portion 14*b*, the inkjet head 15 may be directly mounted on the carriage 13 without including the head base 14.

In the present embodiment, the inkjet printer 10 moves the recording medium 90 in the sub scanning direction with respect to the inkjet head 15 and the UVLED lamp part 16 by transporting the recording medium 90 in the sub scanning direction with respect to the platen 11. However, the inkjet printer 10 may move the inkjet head 15 and the UVLED lamp part 16 in the sub scanning direction with respect to the recording medium 90 by including a mechanism that extends the platen 11 in the sub scanning direction from that shown in FIG. 1 to obtain a so-called flat bed type inkjet printer, and moves the rail 12 and the carriage 13 in the sub scanning direction with respect to the platen 11.

The present invention is adopted in the inkjet printer that prints on a plane in each of the embodiments described above, but may be adopted in an inkjet printer for 3D shaping.

The invention claimed is:

1. An inkjet printer comprising:

a platen that supports a recording medium;

an inkjet head having a nozzle surface on which a nozzle that ejects ink, which cures by being irradiated with light, toward the recording medium supported by the platen is formed;

a light irradiation device that irradiates the ink attached to the recording medium with light; and a carriage that is mounted on the inkjet head and the light irradiation device, and is scanned with respect to the platen, wherein an uneven portion for suppressing stray light from the light irradiation device from reaching the nozzle surface is provided in a portion closer to the nozzle surface than the light irradiation device in a direction in which the carriage is scanned with respect to the platen, and the uneven portion is provided at a position facing a space on a path of the stray light from the light irradiation device to the nozzle surface in a space between the portion and the platen, the uneven portion comprises a plurality of grooves, each groove extends in a direction substantially perpendicular to a main scanning direction of the carriage, the plurality of grooves are disposed side by side at the portion.

2. The inkjet printer as set forth in claim 1, further comprising a head base on which the inkjet head is mounted, wherein the carriage mounts the inkjet head by mounting the head base, and the head base includes the portion.

3. The inkjet printer as set forth in claim 1, wherein the uneven portion is formed on a surface facing the recording medium supported by the platen in the portion, and a distance between the recording medium supported by the platen and a surface of the portion facing the recording medium is shorter than a distance between the recording medium supported by the platen and a surface of the light irradiation device facing the recording medium.

4. The inkjet printer as set forth in claim 1, wherein the carriage includes the portion.

5. The inkjet printer as set forth in claim 1, wherein the portion is formed of metal, and the uneven portion is surface-treated by sandblasting.

6. The inkjet printer as set forth in claim 1, wherein the portion is formed of aluminum, and a surface of the uneven portion is subjected to alumite treatment.

7. The inkjet printer as set forth in claim 1, wherein a surface of the uneven portion is black.

8. The inkjet printer as set forth in claim 1, wherein the stray light is a reflected light reflected by the recording medium supported by the platen.

9. The inkjet printer as set forth in claim 1, wherein the uneven portion is surface-treated to a satin form.

* * * * *